US006695750B2

(12) United States Patent
Esteban

(10) Patent No.: US 6,695,750 B2
(45) Date of Patent: Feb. 24, 2004

(54) REHABILITATION CORRECTIVE APPARATUS FOR WALKING AND RUNNING FOR PERSONS

(76) Inventor: Miguel Angel Sanchez-Osorio Esteban, Urgell, 237-239, 1°-1ª, 08306 Barcelona (ES)

( * ) Notice: Subject to any disclaimer, the term of this patent is extended or adjusted under 35 U.S.C. 154(b) by 292 days.

(21) Appl. No.: 09/813,952

(22) Filed: Mar. 22, 2001

(65) Prior Publication Data

US 2001/0046927 A1 Nov. 29, 2001

(30) Foreign Application Priority Data

May 23, 2000 (ES) ..... 200001362 U

(51) Int. Cl.[7] ..... A63B 22/02

(52) U.S. Cl. ..... 482/54; 482/132; 482/70; 482/51

(58) Field of Search ..... 482/54, 69, 70, 482/51, 132

(56) References Cited

U.S. PATENT DOCUMENTS 5,171,196 A * 12/1992 Lynch ..... 482/7
5,372,561 A * 12/1994 Lynch ..... 482/54
5,707,319 A * 1/1998 Riley ..... 482/54
6,123,649 A * 9/2000 Lee et al. ..... 482/54

* cited by examiner

*Primary Examiner*—Jerome W. Donnelly
(74) *Attorney, Agent, or Firm*—Crowell & Moring LLP

(57) ABSTRACT

A rehabilitation apparatus to correct walking and running for persons is formed by a base or bench supported by legs for support and positioning. Two motorized rollers on the bench turn by way of a transmission which is activated by a motor. On these rollers is mounted a continuous mat or band on which the person stands. On the sides of the bench are mounted two equal structures, resistant and facing, that form the support for the hands of the person on the apparatus. Each of these structures has a support on which is mounted the ends of two arms that move laterally and turn, face each other, and both ending in an end prolongation to support the foot.

3 Claims, 2 Drawing Sheets

REHABILITATION CORRECTIVE APPARATUS FOR WALKING AND RUNNING FOR PERSONS

BACKGROUND OF THE INVENTION

This application claims the priority of Spanish Application 200001362, filed May 23, 2000, the disclosures of which are expressly incorporated by reference herein.

An object of the present invention is to provide an apparatus for achieving perfect rehabilitation from any trauma caused to the foot, or for correction of walking-related problems and pathologies.

There are currently people who have problems and pathologies when and for walking correctly. These problems increase, in general, quantitatively and qualitatively over time, and in the worst cases may cause grave degeneration of the joints.

In an attempt to avoid this, insoles, traditional rehabilitation systems, physiotherapy are used, and even sometimes static recovery bicycles are used.

All these systems do not in general solve the cause of the problem, for example walking correctly, but they can solve the pain and degeneration caused by the problem.

SUMMARY OF THE INVENTION

With the apparatus of the invention, the above-mentioned problems are solved because the use of this apparatus reaffirms the use and treatment of an insole, specially designed and corrected to the needs of the person.

In this apparatus, the person re-learns how to walk or stroll activating muscular work that he or she did not use previously because of the defect, problem or pathology.

The pressure that the person places on the insole correctly placed inside the footwear, allows musclular work to be carried out not only of the respective leg, but of the rest of the body.

According to the invention, the apparatus consists of a base or bench supported by short legs.

On this bench a continuous mat moves by turning like a belt placed on motorized end rollers.

On the longest sides of the bench are two rigid structures to support the units, equal, jointed, tubular and facing.

Each group finishes at the free end in a support element for the foot attached to the footwear at the arch zone using straps.

Each group can be angular and/or triangular in shape, with a pumping effect in a lineal direction, and in either case each one of them ends at the free end with the foot support element.

On the sides of the apparatus, the groups are joined by a device that regulates the changes of direction and rotation until during the last phase of treatment, movement of the groups is linear in the same direction as the turning movement of the apparatus.

BRIEF DESCRIPTION OF THE DRAWINGS

Other objects, advantages and novel features of the present invention will become apparent from the following detailed description of the invention when considered in conjunction with the accompanying drawings wherein.

DETAILED DESCRIPTION OF THE DRAWINGS

Figure 1:
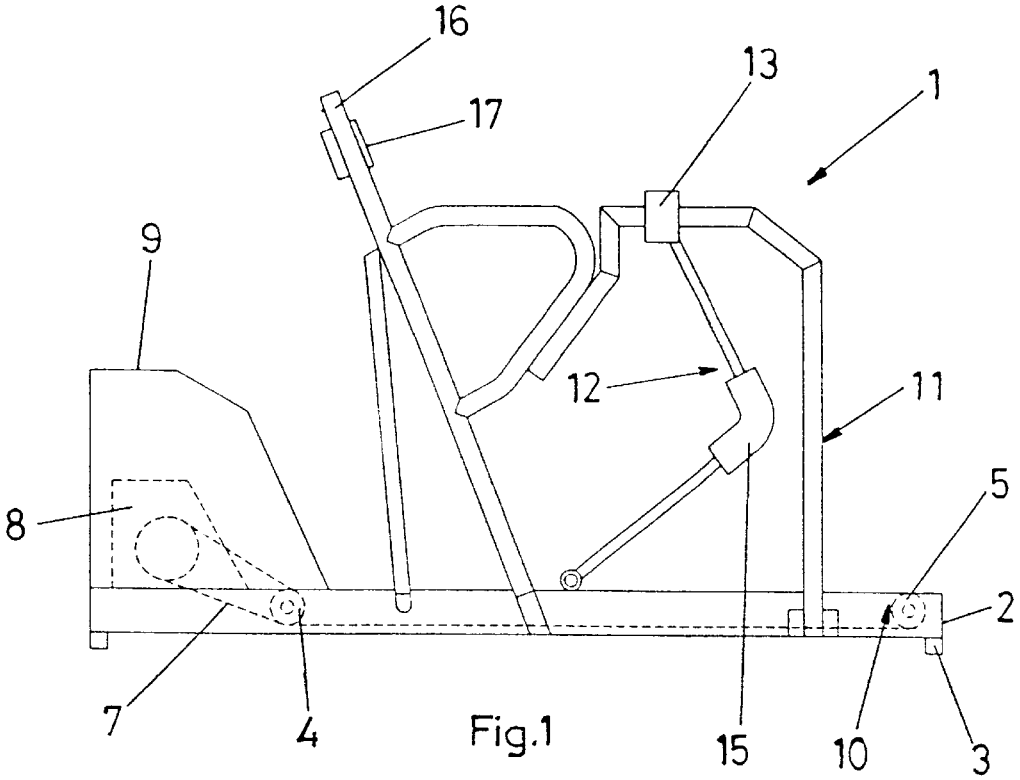
FIG. 1 is a side view of the apparatus according to the present invention.
Figure 2:
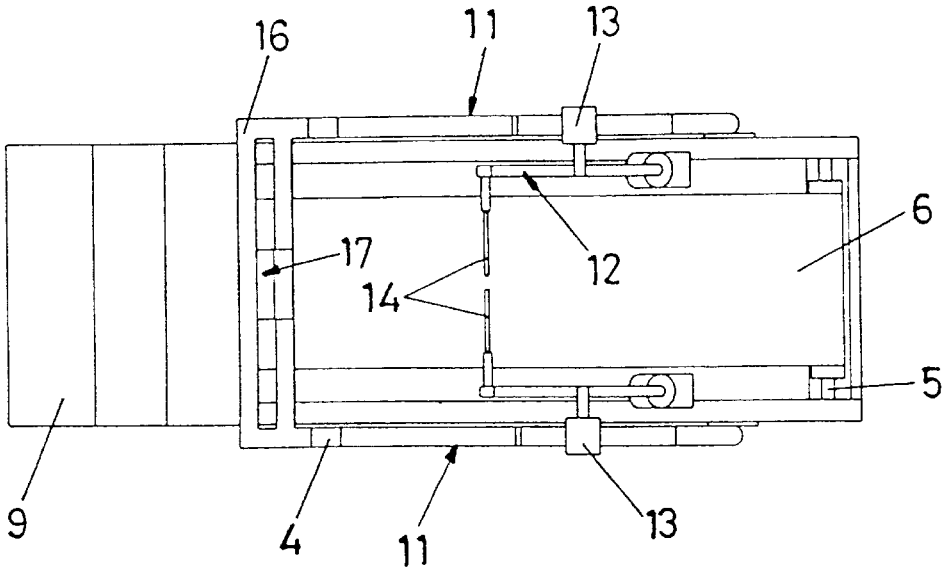
FIG. 2 is a top view of FIG. 1.

The apparatus is formed by a base or bench 2 supported by short legs 3.

On this bench end rollers 4, 5 are placed appropriately, parallel and facing, on which is mounted a mat 6 or continuous belt.

One of these rollers 4 is turned by a transmission 7 that is moved by a motor 8 placed at one end of the base, which motor is covered by an appropriate casing 9.

The lead roller 4 transmits its movement to roller 5 through a transmission 10.

The bench is generally rectangular in shape and on its longest sides are mounted two equal facing structures 11 that serve to support the person who is on the mat 6.

On each one of these structures 11 is mounted an angular arm 12 that is fixed by one end to a support 13 at which is regulated the lateral movement and turn of the arm.

On the free end of the arm is mounted a lateral projection 14 to support the foot of the person who is on the mat 6.

Each angular arm 12 has a triangular shape, and the arm straight has the form of a pump. To form the angle a flexible, cylindrical piece 15 of rubber or any other material appropriate for this use can be used.

Figure 3:
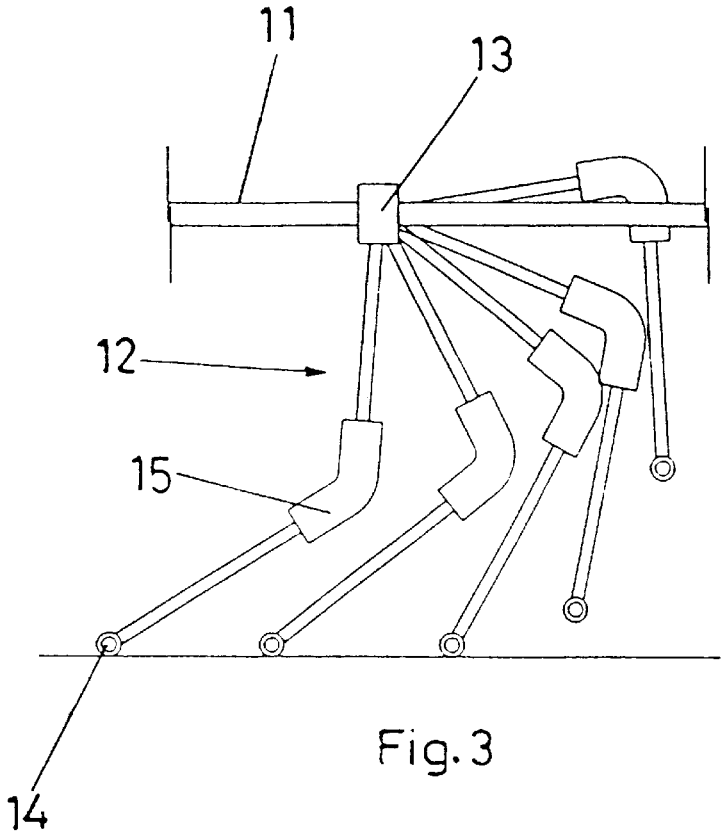
FIG. 3 is a detail of FIG. 1 in a series of different positions of one of the lateral groups.
Figure 4:
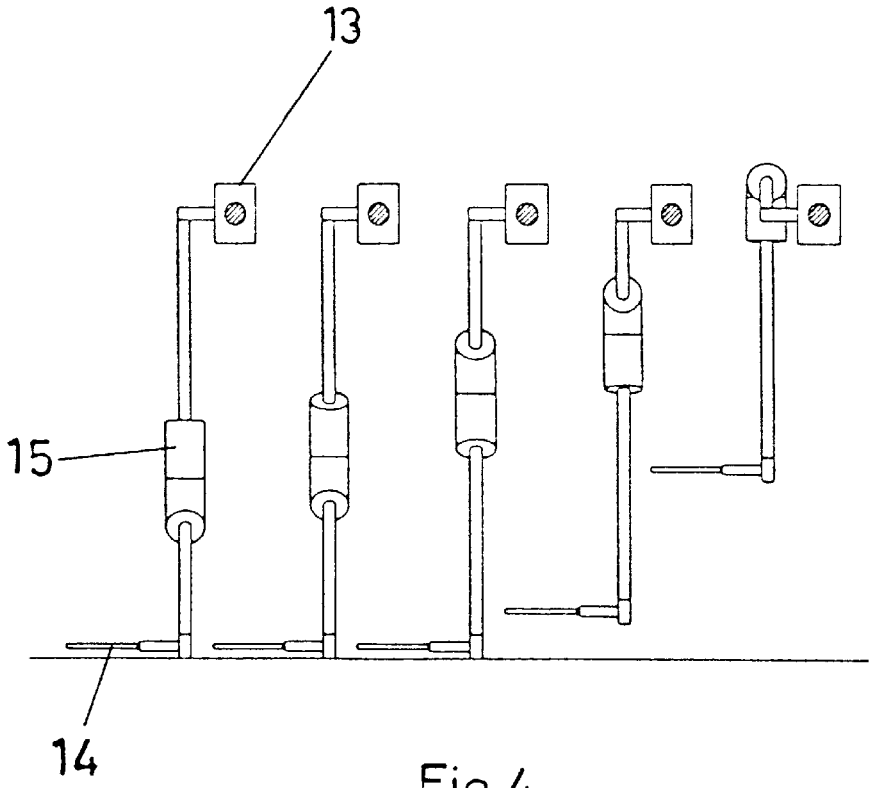
FIG. 4 is a front view of FIG. 3 showing a sequence of the lateral groups in different positions as viewed from the front of the apparatus.

FIGS. 3 and 4 show different views of the sequential positioning when in use of the corresponding angular arm 12.

The support 13 is a piece that allows free turning of the arm 12 and a linear movement of the same, when the arm 12 is to the support 13 is set by pressure or any other appropriate mechanism.

The structures 11 are joined at one end by an upper prolongation or member 16 in which are located the controls 17 to activate the apparatus.

The foregoing disclosure has been set forth merely to illustrate the invention and is not intended to be limiting. Since modifications of the disclosed embodiments incorporating the spirit and substance of the invention may occur to persons skilled in the art, the invention should be construed to include everything within the scope of the appended claims and equivalents thereof.

What is claimed is:

1. Rehabilitation apparatus for correcting walking and running pathologies, comprising: a base, two motorized rollers provided on the base to be driven by a motor-activated transmission, a continuous member arranged to be moved by the rollers, facing structures arranged on opposite sides of the base to form a support for a user's hands, each of the structures having a support on which are mounted ends of two facing arms that are operatively connected to the apparatus and configured to move laterally and turn wherein an end of each of the arms has an elongated foot support.

2. Apparatus according to claim 1, wherein the support for each arm selectively holds the associated arm in a desired position or allows movement in a gradual and controlled manner for at least one of the lateral moving and turning.

3. Apparatus according to claim 1, wherein each arm has an angular shape, and has a flexible piece configured to function as a member that selectively limits angular movement.

* * * * *